United States Patent [19]

Kito et al.

[11] 4,146,756

[45] Mar. 27, 1979

[54] MOVING VOICE COIL TRANSDUCER WITH DIAPHRAGM HAVING CONCENTRIC SECTIONS OF OPPOSITE CURVATURE

[75] Inventors: Isao Kito, Toyokawa; Tamotsu Ito, Yokohama; Toshitaka Sugimoto, Tokyo, all of Japan

[73] Assignee: Hitachi, Ltd., Japan

[21] Appl. No.: 872,871

[22] Filed: Jan. 27, 1978

[30] Foreign Application Priority Data

Jan. 28, 1977 [JP] Japan ..... 52-7710

[51] Int. Cl.[2] ..... H04R 7/12; H04R 9/02

[52] U.S. Cl. ..... 179/115.5 R; 181/165; 181/173

[58] Field of Search ..... 179/115.5 R, 181 R; 181/173, 163, 164, 165

[56] References Cited

U.S. PATENT DOCUMENTS 1,815,987 7/1931 Peterson ..... 181/164

1,876,831 9/1932 Ballantine ..... 179/115.5 R

FOREIGN PATENT DOCUMENTS 928176 11/1947 France ..... 179/181 R

*Primary Examiner*—George G. Stellar

*Attorney, Agent, or Firm*—Craig & Antonelli

[57] ABSTRACT

An electroacoustic transducer in which a diaphragm of a loudspeaker for converting an electrical signal into an acoustic signal comprises a lower section and an upper section thereof which are split axially of a center pole of a magnetic circuit. The lower section of the diaphragm has a concave-curved surface such as an exponential-curved surface while the upper section of the diaphragm has a parabolically-curved surface. A roll is provided at the joint area of the upper and lower sections of the diaphragm. In this manner, a high-band resonance frequency of the loudspeaker is raised to a high frequency and Q of high-band resonance is lowered to broaden a reproduction frequency range of the loudspeaker.

3 Claims, 4 Drawing Figures

MOVING VOICE COIL TRANSDUCER WITH DIAPHRAGM HAVING CONCENTRIC SECTIONS OF OPPOSITE CURVATURE

BACKGROUND OF THE INVENTION

The present invention relates to an electroacoustic transducer for converting an electrical signal into an acoustic signal, and more particularly to a loudspeaker which receives an output signal of an audio-frequency amplifier and converts the audio-frequency output signal into an acoustic signal for reproduction.

It is desirable that a loudspeaker which converts an audio-frequency signal recorded on a disc record or a magnetic tape into an acoustic signal for reproduction produces a uniform sound pressure output over a wide frequency range. In a well-known type of loudspeaker, a voice coil is arranged in an air-gap of a magnetic circuit such that it is vibrated therein, and a diaphragm is connected to the voice coil. An output signal of an audio-frequency amplifier is supplied to the voice coil to vibrate the voice coil in the air-gap to thereby vibrate the diaphragm for producing an acoustic output. The diaphragm is made of paper, metal, synthetic resin or the like and formed in cone shape or dome shape, and the voice coil is connected to the diaphragm. An outer peripheral edge of the diaphragm is supported by a soft material to form a vibration system. The vibration system has a lowest resonance frequency which is determined by a mass of the diaphragm, a mass of the voice coil, a mass of inertia of air and a stiffness of a corrugation edge or a spider which supports the diaphragm. A high-band resonance frequency of the vibration system is determined by the shape, diameter and material of the diaphragm. These resonances cause peaks in low-band and high-band frequencies on a frequency characteristic curve of the loudspeaker. A frequency range within which the loudspeaker can reproduce the acoustic signal is determined by the low-band resonance frequency and the high-band resonance frequency. The farther the distance between those frequencies are, the broader is the frequency range over which the acoustic signal of uniform sound pressure level is reproduced. Accordingly, it is preferable to raise the high-band resonance frequency in order to broaden the reproduction frequency range of the loudspeaker.

The high-band resonance of the loudspeaker is caused mainly by the resonance of the diaphragm itself. Accordingly, by raising the resonance frequency of the diaphragm itself, the high-band resonance frequency of the loudspeaker can be raised. In order to raise the resonance frequency of the diaphragm, it is preferable to form the diaphragm with a material having a high propagation speed for sound, that is, a high Young's modulus material. In this respect, the diaphragm has heretofore been formed with a high Young's modulus metal such as aluminum, titanium or beryllium or mixture of vegetable fiber and carbon fiber. However, since those materials have smaller internal loss than a paper made from vegetable fiber, the diaphragm made of those materials have higher Q (quality factor) of resonance at the high-band resonance than the diaphragm made of the paper, and produce higher peaks in the high-band frequencies of the frequency characteristic curve of the loudspeaker. As a result, the high-band frequencies of the acoustic signal reproduced by the loudspeaker is emphasized and hence the electrical signal cannot be converted into the acoustic signal with high fidelity.

SUMMARY OF THE INVENTION

It is an object of the present invention to provide an electroacoustic transducer having a wide reproduction frequency range.

It is another object of the present invention to provide an electroacoustic transducer having a wide reproduction frequency range and a small peak of sound pressure level in a high-band resonance frequency.

The electroacoustic transducer of the present invention comprises a center pole having a circular magnetic circuit, a yoke associated with the center pole to define a ring air-gap around the center pole, a magnet for applying magnetic flux to the air-gap and a voice coil arranged in the air-gap. An electrical signal is supplied to the voice coil to cause an A.C. magnetic flux generated in the voice coil to react with a D.C. magnetic flux across the air-gap for vibrating the voice coil and hence the diaphragm coupled to the voice coil to produce an acoustic signal. An outer circumferential surface of the diaphragm has an axially symmetrically and parabolically-curved surface and an axially symmetric concave-curved surface a roll is provided at the joint section of the two curved surfaces to change the vibration modes of the two curved surfaces from each other to lower the Q of resonance in the high-band resonance to attain a flat frequency characteristic over a high-band frequencies.

DESCRIPTION OF THE PREFERRED EMBODIMENTS

Figure 1:
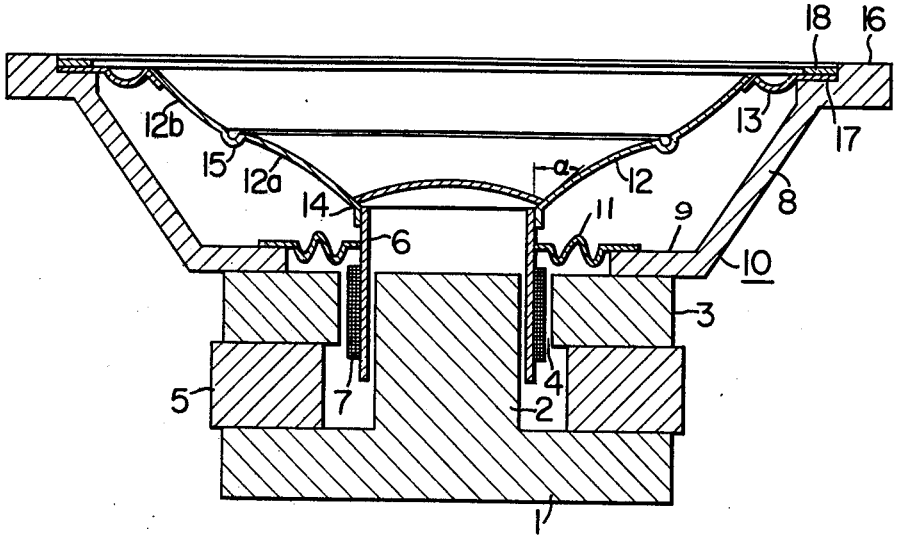
FIG. 1 shows a sectional view illustrating one embodiment of an electroacoustic transducer of the present invention.

Referring to FIG. 1, one embodiment of the electroacoustic transducer of the present invention is explained. In FIG. 1, numeral 1 denotes a lower disc yoke made of a magnetic material such as iron, and a cylindrical center pole 2 is formed integrally at the center of the upper surface of the lower disc yoke 1. Numeral 3 denotes an upper disc yoke made of the same magnetic material as the lower yoke 1, and a hole having a larger diameter than the outer diameter of the center pole 2 is formed at the center of the upper yoke 3. An upper end of the center pole 2 is fitted in the hole, and a circular air-gap 4 is defined by the center pole 2 and the upper yoke 3 around the upper end of the center pole 2. Inserted between the lower yoke 1 and the upper yoke 3 is a magnet 5 which is made of ferrite, for example, and applies a D.C. magnetic flux to the air-gap 4. The lower yoke 1, the center pole 2, the upper yoke 3 and the magent 5 constitute a magnetic circuit of an electroacoustic transducer 10. The lower yoke 1 and the magnet 5 are coupled together by adhesive material, and the upper yoke 3 and the magnet 5 are similarly coupled together by adhesive material.

Inserted in the air-gap 4 is a voice coil bobbin 6 which is made of paper or aluminum and formed in cylindrical shape, and an outer circumference of which a voice coil 7 is wound. A cone-shaped frame 8 is mounted on the upper surface of the upper yoke 3. Mounted at the bottom of the frame 8 is a lower flange 9 which is coupled to the upper yoke 3 by adhesive material or by bolts. Mounted on the upper surface of the flange 9 is an outer periphery of a disc spider 11 which supports the bobbin 6 concentrically with the center pole 2. Coupled to the upper end of the bobbin 6 is a diaphragm 12, an outer periphery of which is attached to the frame 8 by a support member 13. The voice coil bobbin 6, the voice coil 7, the spider 11, the diaphragm 12 and the support member 13 constitute a vibration system of the electroacoustic transducer 10.

The diaphragm 12 is made of a metal such as aluminum, titanium or beryllium or a mixture of paper pulp and carbon fiber. Those materials have small internal loss and propagation speed of sound in those materials is high. Accordingly, with those materials, the high-band resonance frequency of the diaphragm 12 can be raised to a high frequency. The diaphragm 12 is generally of cone shape but it comprises two differently curved surfaces, that is, it comprises a lower section **12*a* of the diaphragm 12 coupled to the voice coil bobbin 6 and an upper section 12*b* of the diaphragm coupled to the support member 13. The lower section 12*a* of the diaphragm has axially symmetrically curved surfaces comprising an outer circumferential surface having concave curve such as exponential curve, hyperbolic curve or catenoidal curve and an inner circumferential surface having convex curve. An apex 14 of the lower section 12*a* of the diaphragm extends to form a cylinder which is bonded to the outer periphery of the bobbin 6. The upper section 12*b* of the diaphragm has an axially symmetric parabolic curve and the soft support member 13 is bonded to the outer periphery thereof. The inner periphery of the upper section 12*b* of the diaphragm and the outer periphery of the lower section 12*a* of the diaphragm is coupled by a roll 15. The upper section 12*b* of the diaphragm, the lower section 12*a* of the diaphragm and the roll 15 are integrally molded by the low internal loss material which constitutes the diaphragm 12**.

Arranged on the frame 8 is an upper flange 16, on the upper surface of which a ring recess 17 is formed, to which recess 17 the support member 13 is bonded. A ring packing 18 is bonded to the support material 13. The vibration system of the electroacoustic transducer 10 is compliantly supported by the spider 11 and the support member 13. An audio-frequency signal from an audio-frequency amplifier is supplied to the voice coil 7, which in turn produces an A.C. magnetic flux around the voice coil 7. By the A.C. magnetic flux thus generated and a D.C. magnetic flux applied to the air-gap 4 by the magnet 5, the voice coil 7 vibrates in the air-gap 4 so that the diaphragm 12 is also vibrated to convert the electrical signal to an acoustic signal.

Figure 2:
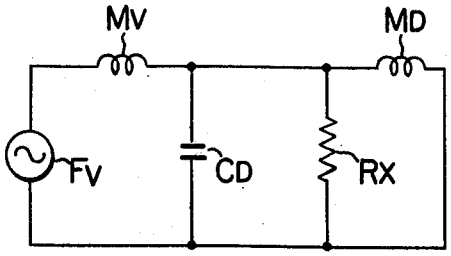
FIG.2 PRIOR ART
FIG. 2 shows an equivalent circuit diagram of a prior art electroacoustic transducer.

FIG. 2 shows an equivalent circuit of a prior art electroacoustic transducer having a parabolically curved diaphragm, near a high-band resonance frequency. In FIG. 2, $F_V$ represents a drive force of the voice coil, $M_V$ an equivalent mass of the voice coil, $M_D$ an equivalent mass of the diaphragm, $C_D$ a compliance at the apex of the diaphragm, and $R_X$ a resistance due to the internal loss of the support member which support the outer periphery of the diaphragm. The compliance $C_D$ at the apex of the diaphragm is experimentally given as follows:

$$C_D = (\sin\alpha)/(2\pi hE\cos^2\alpha) \quad (1)$$

where h is a thickness of the diaphragm, E is a Young's moldulus of the material of the diaphragm, $\alpha$ is a spread angle at the apex of the diaphragm. As shown in FIG. 1, the spread angle $\alpha$ is defined by an angle formed by a tangential line of the diaphragm 12 at the apex 14 thereof and the axial line of the voice coil bobbin 6. The high-band resonance frequency of the electroacoustic transducer is determined by the equivalent mass $M_V$ of the voice coil, the equivalent mass $M_D$ of the diaphragm and the compliance $C_D$ at the apex of the diaphragm. Accordingly, when it is desired to raise the high-band resonance frequency, it is necessary to form the diaphragm with a low-internal-loss material and reduce the masses of the voice coil and the diaphragm to reduce the respective equivalent masses $M_V$ and $M_D$, and further reduce the compliance $C_D$ at the apex of the diaphragm. In order to reduce the compliance $C_D$ at the apex of the diaphragm, it is preferable to reduce the spread angle at the apex of the diaphragm shown in the equation (1).

However, even with such construction, the vibration of the diaphragm during the resonance cannot be fully damped because the diaphragm is made of the low-internal-loss material and the mass of the support material is smaller than the mass of the diaphragm. As a result, the Q at resonance rises.

Figure 3:
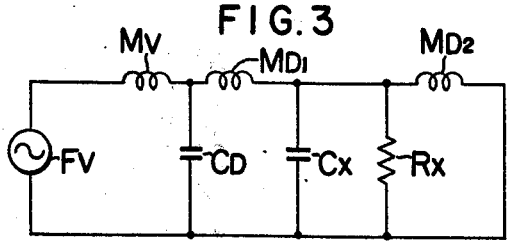
FIG. 3 shows an equivalent circuit diagram of the electroacoustic transducer of the present invention.

FIG. 3 shows an equivalent circuit of the electroacoustic transducer shown in FIG. 1, near the high-band resonance frequency thereof, in which $M_{D1}$ represents an equivalent mass of the lower section **12*a* of the diaphragm, $M_{D2}$ an equivalent mass of the upper section 12*b* of the diaphragm and $C_X$ a compliance at the roll 15. The equivalent mass $M_{D1}$ of the lower section 12*a* of the diaphragm and the equivalent mass $M_{D2}$ of the upper section 12*b* of the diaphragm are connected in series with an equivalent mass $M_V$ of the voice coil 7, and the compliance $C_X$ at the roll 15 and a resistance $R_X$ due to the internal loss of the support member 13 are connected in parallel with the equivalent mass $M_{D2}$ of the upper section 12*b* of the diaphragm. Since the diaphragm 12 is split by the roll 15 to the lower section 12*a* of the diaphragm and the upper section 12*b* of the diaphragm, the equivalent mass $M_D$ of the diaphragm 12 is also split to the equivalent mass $M_{D1}$ of the lower section 12*a* of the diaphragm and the equivalent mass $M_{D2}$ of the upper section 12*b* of the diaphragm. Accordingly, the high-band resonance frequency of the electroacoustic transducer 10 is determined by the equivalent mass $M_V$ of the voice coil 7, the equivalent masses $M_{D1}$ and $M_{D2}$ of the lower and upper sections 12*a* and 12*b* of the diaphragm, the compliance $C_D$ at the apex 14 of the lower section 12*a* of the diaphragm and the compliance $C_X$ of the roll 15. In order to raise the high-band resonance frequency, it is necessary to reduce the masses of the voice coil 7 and the lower and upper sections 12*a* and 12*b* of the diaphragms, and at the same time reduce the compliance $C_D$ at the apex 14. To this end, it is preferable to reduce the spread angle $\alpha$ at the apex 14 of the lower section 12*a* of the diaphragm. As shown in FIG. 1, the outer circumferential surface of the lower section 12*a* of the diaphragm has the concave-curved surface such as exponential curve, hyperbolic curve or catenoidal curve. As a result, the spread angle $\alpha$ at the apex 14 of the lower section 12*a* of the diaphragm is reduced, and the compliance $C_D$ at the apex 14 is reduced so that the high-band resonance frequency of the lower section 12***a* of the diaphragm is raised. The upper section 12*b* of the diaphragm is connected to the lower section 12*a* of the diaphragm by the roll 15 and it has the parabolically-curved surface such that the curved surfaces of the upper section 12*b* of the diaphragm and the lower section 12*a* of the diaphragm are symmetrical to each other at the roll 15. As a result, the vibration mode of the upper section 12*b* of the diaphragm becomes clearly different from that of the lower section 12*a* of the diaphragm and then the lower section 12*a* of the diaphragm comes to be independent of the upper section 12*b* of the diaphragm. The outer periphery of the upper section 12*b* of the diaphragm vibrates while it is compliantly supported by the support member 13 and it is also damped by the internal loss of the support member 13. Since the mass of the upper section 12*b* of the diaphragm is smaller than the mass of the entire diaphragm 12, it is fully damped by the internal loss of the support member 13 to lower the Q at resonance in the high-band resonance of the upper section 12*b* of the diaphragm. The fully damped upper section 12*b* of the diaphragm acts on the lower section 12*a* of the diaphragm to damp the latter during the resonance of the lower section 12*a* of the diaphragm to lower the Q at resonance of the lower section 12*a* of the diaphragm.

Since the diaphragm 12 is split to the lower section 12*a* of the diaphragm and the upper section 12*b* of the diaphragm and the lower section 12*a* of the diaphragm has the curved surface so as to reduce the spread angle $\alpha$ at the apex 14 thereof, the high-band resonance frequency of the diaphragm 12 is raised so that the reproduction frequency range of the electroacoustic transducer can be broadened. Furthermore, since the upper section 12*b* of the diaphragm has small mass, it can be fully damped by the support member 13 so that the Q at high-band resonance of the diaphragm 12 is reduced and the acoustic signal of uniform sound pressure level over a high frequency is produced.

Figure 4:
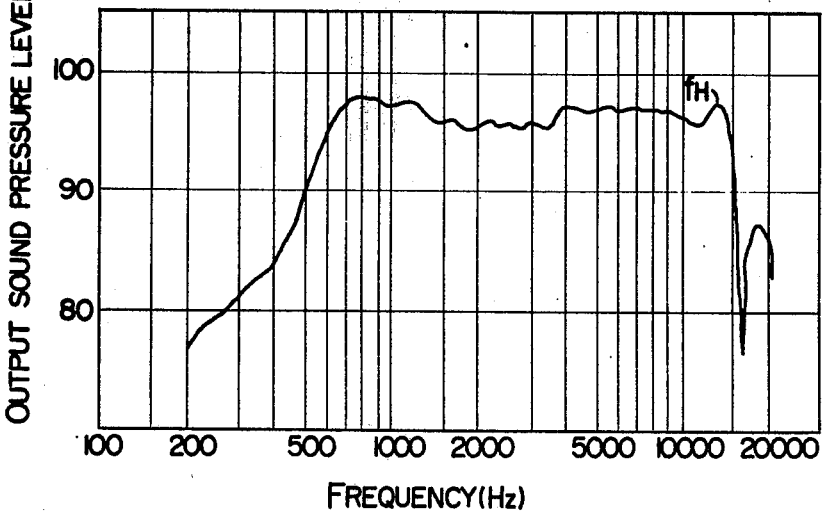
FIG. 4 shows a frequency characteristic curve of the electroacoustic transducer of the present invention.

FIG. 4 shows a characteristic curve of a frequency to sound pressure level of the electroacoustic transducer in accordance with the present invention. A peak $f_H$ due to the high-band resonance which appears near 14,000 Hz shows a sound pressure of approximately 97 dB, which is not substantially different from a sound pressure level near 5,000 Hz. It is thus apparent that the present electroacoustic transducer can reproduce the acoustic signal of uniform sound pressure level over high-band frequencies.

The specification of the electroacoustic transducer used to measure the characteristic curve is as follows:

diaphragm: aluminum of 40 microns thickness.
outer diameter of diaphragm: 37 mm
inner diameter of diaphragm: 14 mm
inner diameter of roll: 24 mm
size of roll: 1 mm in diameter
lower diaphragm: exponential curve
upper diaphragm: parabolic curve The diaphragm 12 is formed by pressurizing an aluminium sheet with use of upper and lower metal molds having the inner contours of the curved surface of the upper section 12*b* of the diaphragm, the curved surface of the lower section 12*a* of the diaphragm and the curved surface of the roll 15.

We claim:

1. An electroacoustic transducer comprising:

a magnetic circuit including a cylindrical center pole, a yoke associated with said center pole to define a ring air-gap therearound, and a magnet for applying magnetic flux to said air-gap;

a voice coil inserted in said air-gap for receiving an electrical signal to vibrate itself axially of said center pole in cooperation with said magnetic flux extending across said air-gap; and a diaphragm made of low internal loss material including a lower section coupled to said voice coil and having an outer circumferential surface which is an axially symmetrically curved surface of concave curve, an upper section having an outer circumferential surface which is an axially symmetrically curved surface of parabolic curve thereby curving in the opposite direction from said lower section, and a roll of the same material as the upper and lower sections molded into a unitary body with said lower and upper sections to combine said lower and upper sections into a unitary body so that the two differently curved upper and lower sections will have a different vibration mode from each other to vibrate independently from one another to reduce the Q of resonance in the high-band resonance of the transducer.

2. An electroacoustic transducer comprising:

a magnetic circuit including a cylindrical center pole, a yoke associated with said center pole to define a ring air-gap therearound and a magnet for applying magnetic flux to said air-gap;

a voice coil inserted in said air-gap for receiving an electrical signal to vibrate itself axially of said center pole in cooperation with said magnetic flux extending across said air-gap; and a diaphragm made of low internal loss material including a lower section having an outer circumferential surface of an axially symmetrically curved surface of concave curve and having an apex made of a thin metal plate and coupled to said voice coil, an upper section having an outer circumferential surface of an axially symmetrically curved surface of parabolic curve thereby curving in the opposite direction from said lower section, and a ringed roll of the same material as the upper and lower sections molded into a unitary body with said lower and upper sections to combine said lower and upper sections into a unitary body so that the two differently curved upper and lower sections will have a different vibration mode from each other to vibrate independently from one another to reduce the Q of resonance in the high-band resonance of the transducer.

3. An electroacoustic transducer according to claim 2, wherein said diaphragm is made of a thin plate of aluminum, and said lower section has an outer circumferential surface which has an axially symmetrically curved surface of an exponential curve.

* * * * *